US007401636B2

(12) United States Patent
O'Donnell et al.

(10) Patent No.: US 7,401,636 B2
(45) Date of Patent: Jul. 22, 2008

(54) FLEXIBLE DIE CAST FACE PLATES

(75) Inventors: Brian P. O'Donnell, New Windsor, NY (US); Daniel C. Krebs, Fair Lawn, NJ (US); Lawrence D. Fox, Nanuet, NY (US); Albert N. A. Pedoeem, West Orange, NJ (US)

(73) Assignee: Fujitsu Limited, Kawasaki (JP)

( * ) Notice: Subject to any disclaimer, the term of this patent is extended or adjusted under 35 U.S.C. 154(b) by 366 days.

(21) Appl. No.: 10/866,241

(22) Filed: Jun. 14, 2004

(65) Prior Publication Data

US 2005/0274481 A1 Dec. 15, 2005

(51) Int. Cl.
*B22D 17/00* (2006.01)
*B22D 33/04* (2006.01)

(52) U.S. Cl. ..... 164/113; 164/137

(58) Field of Classification Search ..... 164/113, 164/312, 339, 137

See application file for complete search history.

(56) References Cited

U.S. PATENT DOCUMENTS 4,547,034 A * 10/1985 Forberg et al. ..... 439/406
5,372,758 A * 12/1994 Lundstrom et al. ..... 264/1.25
6,285,548 B1 * 9/2001 Hamlet et al. ..... 361/695
6,782,940 B2 * 8/2004 Billiet et al. ..... 164/6

* cited by examiner

*Primary Examiner*—Jonathan Johnson
*Assistant Examiner*—I.-H. Lin
(74) *Attorney, Agent, or Firm*—Hanify & King P.C.

(57) ABSTRACT

A flexible die case system for forming a variety of face plates used in telecommunications equipment without having to replace the mold base is provided. The system includes a main insert for forming a first portion of the face plate and a sub-insert for forming a second portion of the face plate. The second portion includes the minor variations that might be required to accommodate minor variations in face plate requirements. For example, the second portion can be used to change the number, size and location of apertures used for light emitting diodes, as well as the number, size and location of ports used to make connections to the electronics carried by or associated with the face plate.

6 Claims, 6 Drawing Sheets

16
14
12
18
10(A)
20
22
10(B)
24
26
28
10(C)
32
30
10(D)

34(A)
34(B)
34(C)
34(D)
36
38
40
40(A)
42
44
46
48
50
52
54
56
58
60
62
64
65
66
68
70
72
74
76

FLEXIBLE DIE CAST FACE PLATES

BACKGROUND OF THE INVENTION

The present invention relates to face plates used in rack-type electronic modular assemblies of the type used in telecommunications equipment, and more particularly, methods for casting face plates using removable inserts to thus create multiple variations of basic face plate designs without having to recreate full die pieces for each variation.

DESCRIPTION OF THE RELATED ART

In certain types of communications and/or computer systems it is common to employ modular, electrical components which are adapted to be carried by a rack or other retaining structure. On the front side of the rack or retaining structure, the components are accessible by technicians for replacement, removal, and/or repair.

The modular components typically include a face plate which protects sensitive electrical features of the component, including circuits, transistors, processors, etc. The face plate may include physical features that aid in the mounting of the component to the rack or retaining structure. These features are typically provided on the upper and/or lower ends of the face plate.

The front surface of the face plate typically includes indicator lights employing LEDs or other means that signal power on/off, system functions etc., and may further include connector ports for connecting, for example, optical fiber cables to the electronic components.

Face plates may be made by die casting metal, or by stamping metal, or by other means. Die casting is desirable because of the complexity of the design and the quality of the finished product and the elimination of subsequent processing steps that are typically required to finish a metal stamping.

While die casting is a preferred method for forming face plates, the advantages can be diminished by cost and time-to-production issues necessitated by the need for slight variations in face plates. For example, a particular design of a face plate may require tens of thousands of dollars to design and build the tooling necessary to make the die castings. If that design employed a single connector port for an optical fiber connector, and it became necessary to have a two port connector face plate, a new set of tooling would have to be commissioned at relatively high cost and with inevitable time delays.

SUMMARY OF THE INVENTION

The present invention solves the aforementioned problems by providing a method of making face plates and other die cast electrical components by employing a flexible casting system in which multiple variations of a basic design can be manufactured using the same basic casting tools.

The flexible casting system includes a first major die portion or mold base, a second major die portion or main face plate insert which mates with the first major die portion to form a base tool cavity contoured to form a substantial portion of a casting, and at least one sub-insert removably positioned in the mold cavity to direct material flowing into the mold cavity to form a specific feature.

Preferably, the system employs multiple sub-inserts to provide, for example, multiple variations of a basic face plate design. The variations include face plates with no connector ports, one connector port, two connector ports, and so on.

Other face plate variations include no apertures for indicator lights, switches, etc., one aperture, two apertures, and so on.

The sub-inserts can be made with relative ease, and employed in a basic set of casting tools which are relatively more difficult to manufacture. Thus, the advantages of the present invention include reduced time to manufacture, by avoiding having to duplicate basic tool components. Moreover, a cost savings can be realized by not having to duplicate relatively expensive toolings.

Many of the advantages and feature of the present invention will become more apparent in view of the following detailed description and drawings.

DETAILED DESCRIPTION OF THE PREFERRED EMBODIMENTS

FIGS. 1A through 1D show perspectively four different variations of a common face plate design. Each face plate 10(A) through 10(D) is preferably die cast of metal material to comprise an integrally formed structure used in a rack or other electronics device structural system. The preferred face plate design is used to allow easy access to, and plug-in, plug-out functionality for, various components. In a particularly preferred embodiment, the face plates are used in SONET optical communication systems. Typically, the rear of the face plate covers sensitive electrical circuits and components, while the front of the face plate faces outwardly into a computer or communications component room or "closet."

Figures 1A, 1B, 1C, 1D:
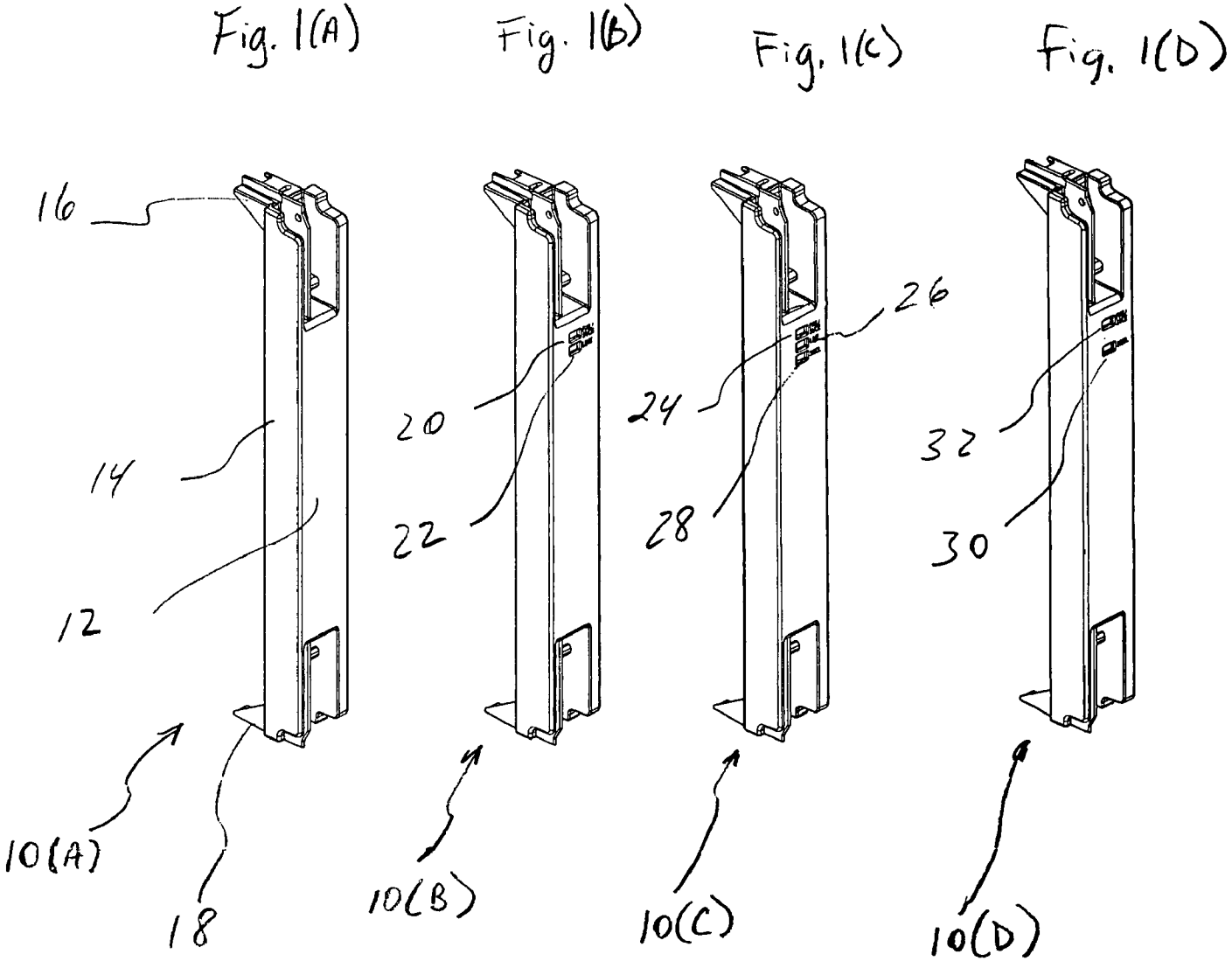
FIGS. 1A-1D are perspective views showing a series of face plates, each having a slightly different front surface features but in all other aspects identical dimensions and features.

Each face plate has in common most physical features and dimensions including (with reference to FIG. 1(A)) a front surface 12, two opposite side surfaces 14 integrally formed at substantially a right angle to the front surface 12 to thus define a substantially U-shaped structure. The opposite side surfaces 14 are typically non-featured so as to provide, if desired, relatively tight spacing, side-by-side, between adjacent face plates in a rack or other structural device.

The upper and lower ends of each face plate 10(A) through 10(D) include mounting features that allow secure connection of the face plate and associated components to an associated mounting structure. These mounting features include (again, with reference to FIG. 1(A)) a rearwardly projecting upper tang 16 and a rearwardly projecting lower tang 18, each of which cooperates with corresponding structures in the rack and also corresponding structures used as a frame for the electronic components mounted behind the face plate. Thus, face plate can be connected to the frame, mother board or other components and then in modular form, the face plate and associated components can be connected to the rack or other similar structures.

It will become apparent from examining the front surface 12 of each face plate 10(A) through 10(D) that there are slight differences between them. For example, the front surface 12 of face plate 10(A) has no openings nor any features of any kind. In essence, the front surface of face plate 10(A) is smooth, planar, and free of openings, indentations, or other features.

In contrast, the face plate 10(B) includes on its front surface two apertures or holes 20 and 22 located at or near the upper end of the face plate. These openings are accompanied by some text, acronyms or other writing to indicate to a technician what the openings are for. By way of example, the openings may be adapted to receive LED's or other light emitting devices or other indicator means that are powered from the electronics on the opposite side of the face plate. These are basically indicator lights to, for example, indicate a system failure, power on/off, state of operations, etc. Depending on the system purchased by a particular customer, or on the features of the system, a system may typically employ several types of face plates, depending on the constituent electronics carried by the face plate. Thus, a system may employ both the face plate 10(A) and 10(B), side-by-side, or otherwise disposed in the same rack or mounting structure.

Referring to FIG. 1(C), a series of apertures 24, 26, and 28 are provided in the front surface of the face plate 10(C), at approximately the same location as the apertures of the face plate 10(B). This variation reflects the need for one additional indicator light or indicator means for the electronic components associated with the face plate 10(C). Similarly, the face plate 10(D) includes two apertures 30 and 32, corresponding in location to the apertures 24 and 28, respectively.

The various apertures may have similar or the same indications at the same locations. Thus, apertures 20, 24, and 32, which preferably are located at the same position on the front surface of each corresponding face plate, may each received the same type of indicator light, such as system on/off, so that the technician can, at a glance at multiple side-by-side face plates, determine that all, some or none are functioning.

While this may be an advantage, it is not necessary to have the apertures in the same place for the same indication. Moreover, the location and number of apertures is intended to show examples, not limitations, as to locations, numbers and variations. For example, the front surface of each face plate could include any number of apertures at any of a variety of locations in a variety of spatial relations to each other.

FIGS. 2(A) through 2(D) are similar to the face plates of FIGS. 1(A) through 1(D). However, in the FIG. 2 series, the number and location of apertures remains consistent from one to the other, but the face plates have a different number of access ports, as will be explained below.

Figures 2A, 2B, 2C, 2D:
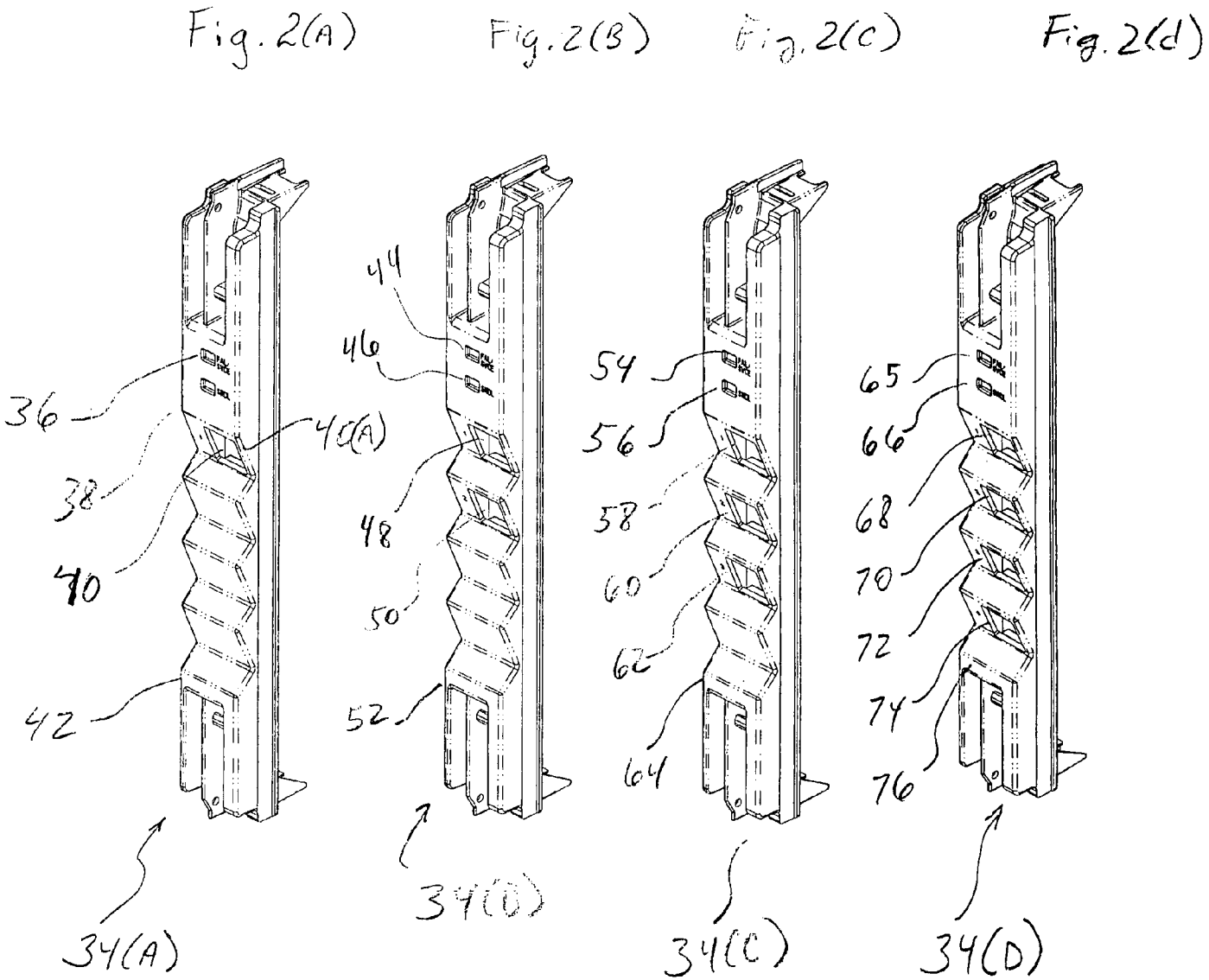
FIGS. 2A-2D, similar to FIGS. 1A-1D, are perspective views showing a series of face plates, each having slightly different front surface features but in all other aspects identical dimensions and features.

FIG. 2(A) illustrates a face plate 34(A) which is similar to the face plates described with reference to FIG. 1(A) through 1(D). In particular, the face plate 34(A) may preferably have all the same basic geometric features and dimensions as the FIG. 1 series, except for the inclusions of access ports. While the face plate 34(A) includes two apertures 36 and 38 designed and included for purposes described above, the face plate 34(A) has the additional feature of an access port 40 which is used to receive the coupler end of an optical conduit.

It should be noted that the face plates described herein are specifically designed for use in SONET or other optical communications equipment, but the invention is not limited to such uses. Face plates for other equipment, and other structures confronting similar, related or analogous problems can be formed using the inventive techniques and structures described herein.

The access port 40 is an opening formed in a chevron-patterned portion of the front surface 42. When the face plate 34(A) is in use, it is substantially vertically oriented. Thus, it is preferable that the port 40 is formed in the inwardly sloping surface 40(A) of the chevron patterned front surface 42. This has the desired effect of causing the corresponding coupler to orient itself in a downwardly extending position, thus providing some protection from accidental removal, disconnection, or damage.

Except for the chevron-patterned front surface, the face plate 34(A) is preferably in all other aspects identical to the face plates of the FIG. 1 series, with the exception of location and number of apertures. In other words, the overall dimensions of the face plate 34(A) are the same as the overall dimensions of the face plates 10(A) through 10(D), thus permitting standardized connections for electronic components to the face plate and of the face plate to a corresponding rack or similar structure.

Likewise, face plate 34(B) differs from face plate 34(A) in only slight ways. Indicator light apertures 44 and 46 are disposed at the same location and indicate the same things as apertures 36 and 38, respectively. Moreover, an access port 48 is located in the same location as access port 40 of the face plate 34(A). However, in the face plate of FIG. 2(B), an additional access port 50 is provided in the chevron-patterned portion of the front face 52. As with port 48, the port 50 is preferably formed on an inwardly sloping surface of the front surface so that, when a conduit is connected, the coupler thereof extends downwardly to provide a measure of protection.

Referring to FIG. 2(C), the face plate 34(C) includes apertures 54 and 56 which are of the same type, location and spacing as those in FIGS. 2(A) and 2(B). However, the face plate 34(C) includes three access ports 58, 60, and 62 formed in the chevron-patterned front surface 64. As in the other FIG. 2 series face plates, the ports are formed in the inwardly sloping surface of the chevron pattern so that the couplers extend downwardly to thus provide protection.

Referring to FIG. 2(D), the face plate 34(D) includes apertures 65 and 66 which are of the same type, location and spacing as those in FIGS. 2(A), 2(B) and 2(C). However, the face plate 34(D) includes four access ports 68, 70, and 72 and 74 formed in the chevron-patterned front surface 76. As in the other FIG. 2 series face plates, the ports are formed in the inwardly sloping surface of the chevron pattern so that the couplers extend downwardly to thus provide protection.

As is apparent from the foregoing descriptions, it is possible to build optical systems in which multiple face plates are employed, with each having relatively slight differences from one to the next. In the manufacturing of these face plates, it has been in the past required to supply a new die set to cast each different face plate, no matter how slight the variations. Die sets are generally expensive and time consuming to manufacture.

Figure 3:
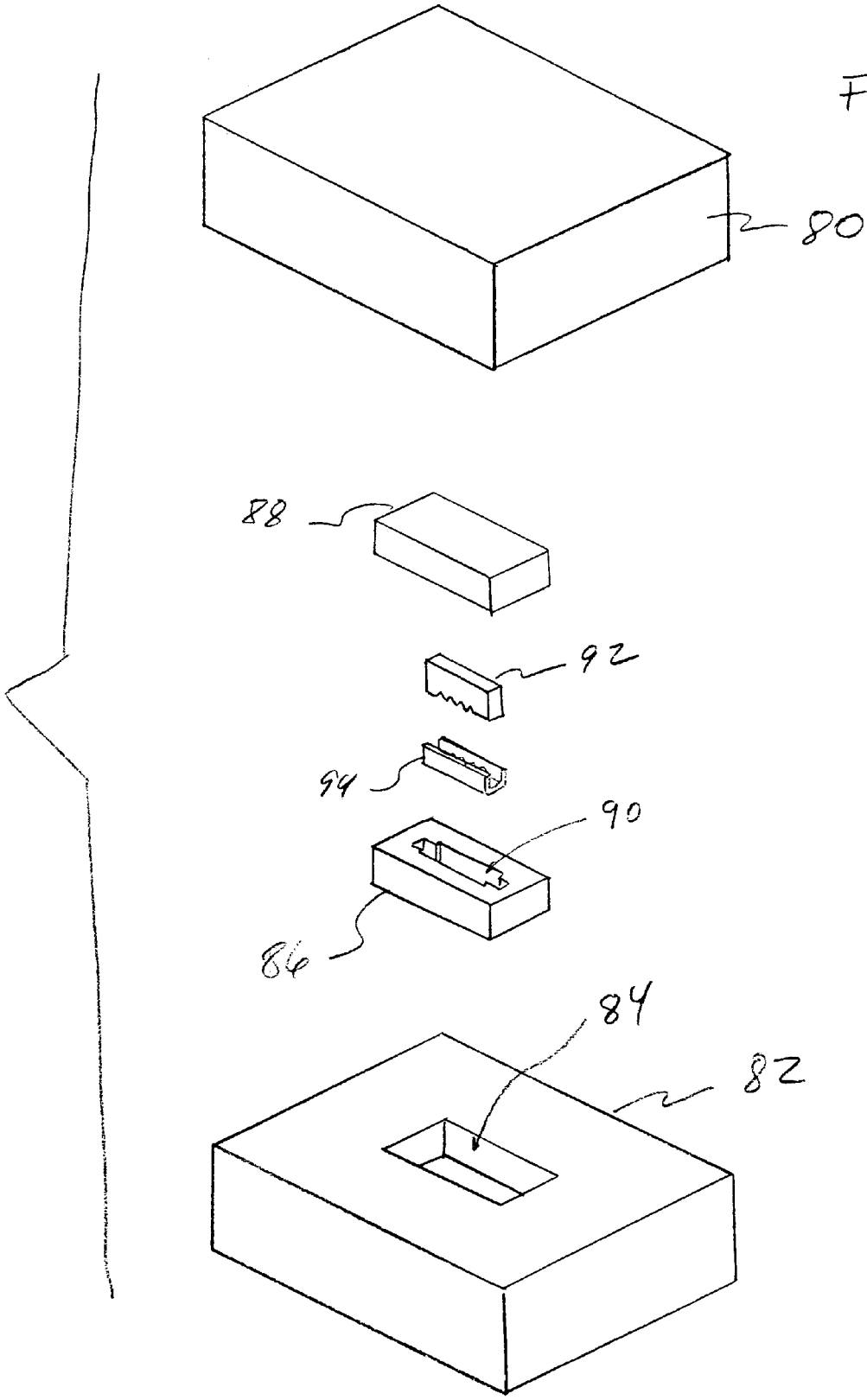
FIG. 3 is an exploded view showing the mold components used to form the face plates of the present invention.

Referring now to FIG. 3, a die casting system is illustrated in which a basic die set is modified by adding or subtracting sub-inserts. The sub-inserts are configured and used to account for the slight differences in face plates, examples of which were mentioned above. The basic methodology of the casting system can be described as follows. A method of forming an object includes forming a cavity between two basic die halves, the cavity having spaced-apart surfaces which define a general form of a face plate used in a telecommunications system, placing at least one sub-insert in the cavity, the at least one sub-insert cooperating with the spaced-apart surfaces to thus define a modification to the general form of the face plate, filling the cavity with a heated material, and removing a face plate from the cavity after the material has sufficiently cooled.

As it is preferred to make the face plates by die casting, the material is preferably molten metal, such as aluminum or aluminum based alloys. Other materials could be employed, including thermoplastic and/or thermosetting plastic materials employing injection molding techniques.

As seen in FIG. 3, the method includes use of a first or top mold base 80 and a second or bottom mold base 82. Mold base 80 constitutes the ejector half and mold base 82 the cavity half. These two structures typically form the bulk of the die, and are illustrated in simplistic form. They would typically include cooling channels, ejector pins, alignment mechanisms, and other structures to facilitate the basic die casting process. They are also bulky by design, formed of steel or other high strength materials, and usually include a cavity constituting the shape of the product to be molded.

In the present invention, the mold base 82 includes a rectangular recess 84, which shall hold the cavity main insert when the ejector half 80 is placed together with the mold base 82 and secured together by normal means.

The present invention includes a main insert cavity half 86 and a main insert ejector half 88 which cooperate to define the basic shape of the face plate or final product. When placed together, the main insert cavity half 86 and ejector half 88 form a product-shaped cavity 90. The two halves 86 and 88 fit within the basic cavity 84.

In particular, ejector half 88 will fit into a recess within mold base 80, and cavity half 86 will fit into the recess 84 of mold base 82. Ejector half 92 will fit into a recess in ejector half 88, which as noted, will fit into a recess in mold base 80.

To form the chevron-shaped front surface shown in the embodiments of the series shown in FIG. 2, the method provides a sub-insert ejector half 92 and a sub-insert cavity half 94 which, when fitted into the cavity 90, will define the front surface of the face plate after die casting.

Figure 4:
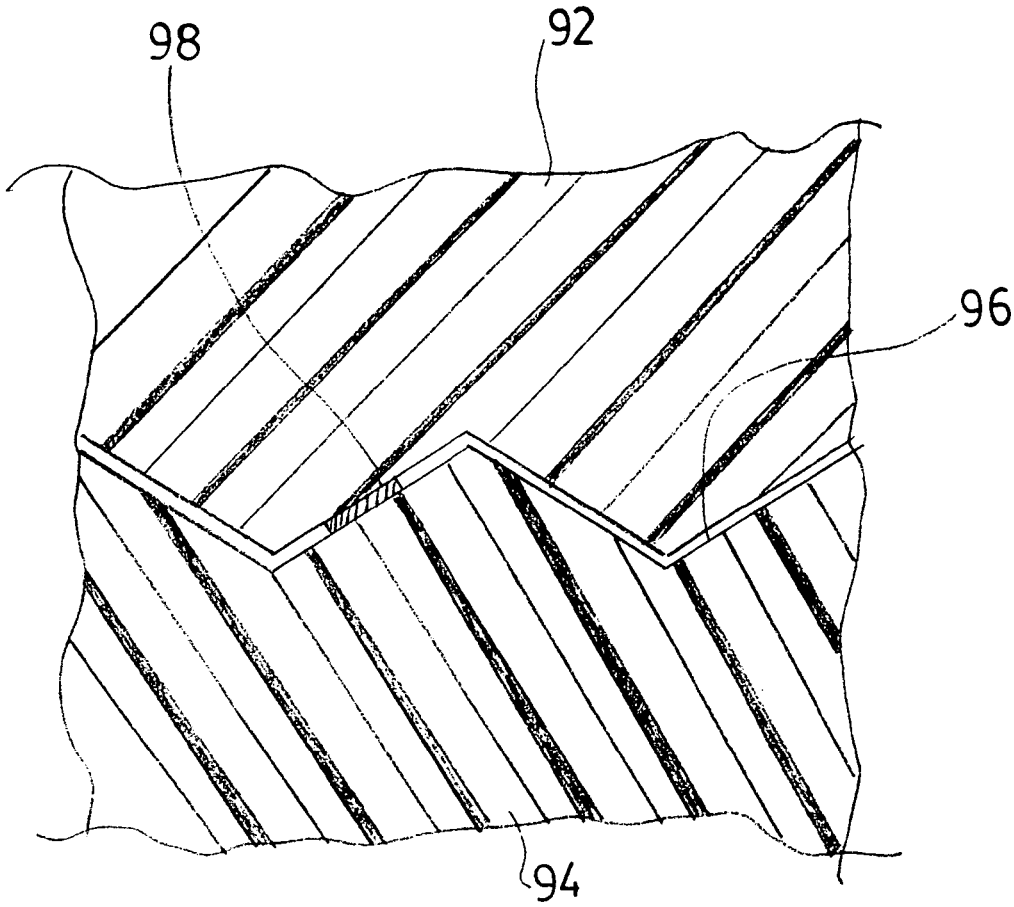
FIG. 4 is an enlarged cross-sectional view showing details of the juxtaposed surfaces that form the chevron-shaped portion of the front surface of the face plate.

To illustrate this, reference is made to FIG. 4, in which the sub-insert cavity half 94 is shown in assembled position juxtaposed the sub-insert ejector half 92, whereby opposing surfaces thereof define a chevron-shaped portion 96 of the mold cavity. When filled with material, the chevron-shaped portion of the cavity defines the chevron-shaped front surface of the face plate.

In order to form one or more of the access ports, it will be necessary to have opposing surfaces of the two components 92 and 94 touch in an area predetermined to define the size and shape of the port. This can be done by making formations, or protruding lands, on the sub-inserts, or by providing further inserts, such as insert 98 shown in FIG. 4. This insert 98 will prevent material from flowing into the area between the two sub-inserts to thus define the size and shape of the port.

Figure 5:
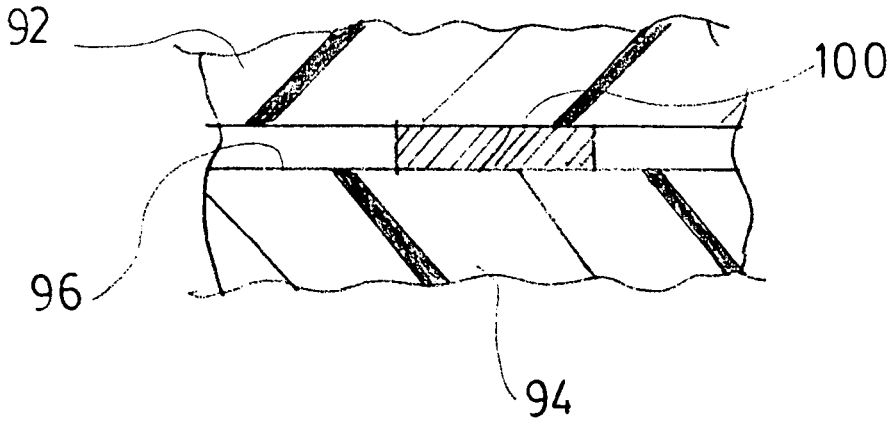
FIG. 5 is an enlarged cross-sectional view showing details of the juxtaposed surfaces that form the flat front surface of the face plate, as an additional type of face plate compared to the FIG. 4 type.

If it is desired to have a flat front surface, the sub-inserts may include simply a number of smaller inserts such as sub-insert 100 of FIG. 5, which can simply be disposed between flat portions of the sub-inserts 92 and 94, thus preventing the flow of material in selected areas of the flat surface portion 96 of the mold cavity. It can be seen that the number and location of inserts 100 can be selected to coincide with the number and location of apertures needed for a particular face plate.

For example, the sub-insert 100 of FIG. 5 could be used to form any of the apertures 20, 22, 24, 26, 28, 30, 32, 36, 38, 44, 46, 54, 56, 65, and 66. These apertures could be formed on front surfaces having flat, chevron, or other desired shapes.

In any event, inserts such as insert 98, or other surface formations provided on mating sub-inserts, could be used to form the ports on front surfaces with or without apertures.

By using sub-inserts, the present invention allows the manufacture of a wide variety of face plates and other objects without having to replace the relatively expensive and bulky base molds. The system described herein allows for flexibility in the manufacture of a product that may require slight variation from one to the other without having to invest relatively large amounts of capital and time in the development of new molds.

The method of making a face plate according to the present invention can be described as a method which uses successively and selectively inserts within a basic mold base. The basic or primary cavity 84 is formed in the base mold, which itself is made when the ejector half 80 is juxtaposed the cavity half 82. A first cavity portion 90 is formed in a main insert which is formed when the ejector half 88 is juxtaposed the cavity half 86. The first cavity portion 90 has a shape substantially corresponding to an overall size and shape of the face plate. A second cavity portion is formed by juxtaposing the sub-insert ejector half 92 and the sub-insert cavity half 94. The second cavity portion has a shape substantially corresponding to a particular feature of the face plate, such as the chevron-shaped front surface.

To form a face plate, the sub-insert is placed within the main insert, and the main insert is placed within the base cavity, thus completely forming a face plate cavity. The face plate cavity is then filled with material, such as molten metal material, as is normally done in die castings. Then, a molded face plate is removed from the face plate cavity once the material has sufficiently cooled, by separating the ejector half 80 from the cavity half 82. After molding, elements 92 and 88 will remain within ejector half 80, and elements 94 and 86 will remain within cavity half 82. Elements 88, 92, 94, and 86 are only removed from halves 80 and 82 to make different face plate features.

Figure 6:
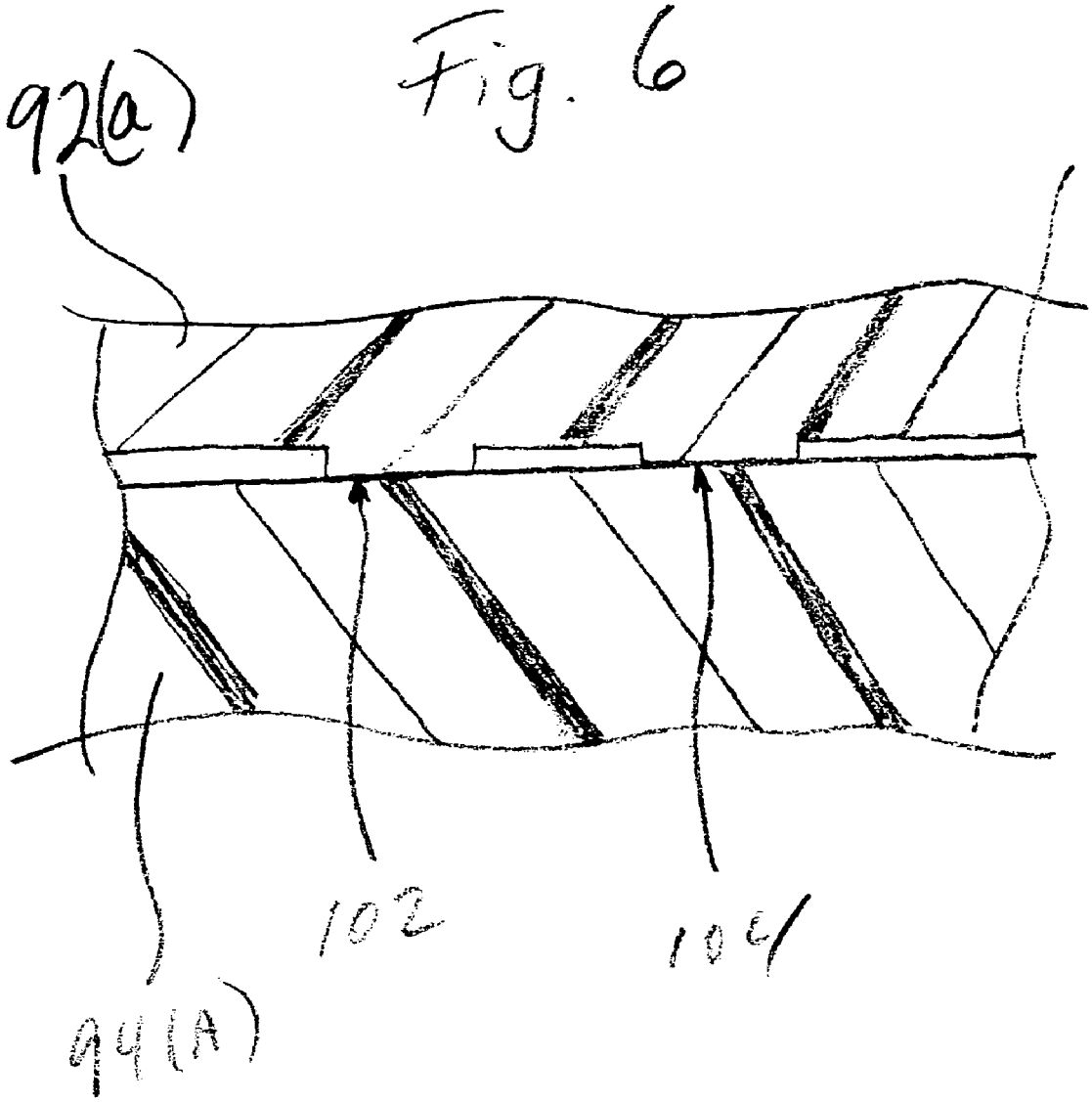
FIG. 6 is an enlarge cross-sectional view showing details of the juxtaposed surfaces that form the flat front surface of the face plate, with the aperture-forming extensions shown as a part of the basic sub-insert parts (not as separate or tertiary inserts as in FIG. 5)

FIG. 6 illustrates how the sub-insert could be configured to form a flat face with two apertures. In particular, the ejector half 92(A) of the sub-insert has a flat surface with two extensions 102 and 104 each having an area and shape corresponding to the area and shape of the apertures. Each extension has a length adapted to bring them into contact with the opposed flat surface of the cavity half sub-insert 94(A).

Figure 7:
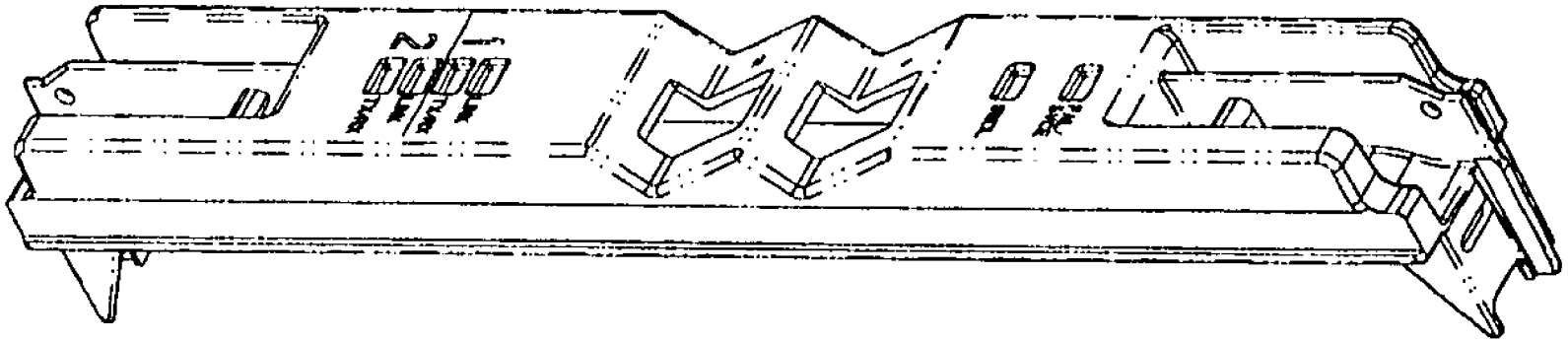
FIG. 7 shows a finished face plate having multiple indicator light apertures and multiple access ports, being a product of the present inventive methodology and molding apparatus.

FIG. 7 illustrates a finished product or face plate after molding using the methods and devices disclosed herein. It is noted that the face plate includes multiple indicator light apertures and multiple access ports, along with a chevron formation for the access ports. This illustrates the wide variety of face plates that are achievable using the present invention and the disclosed inserts. The face plate of FIG. 7 is included to show yet another variation achievable with the flexible die casting system of the present invention.

From the foregoing it is believed that those skilled in the pertinent art will recognize that while the invention has been described in association with a preferred embodiment thereof, numerous modifications, changes and substitution of equivalents may be made therein without departing from the spirit and scope of this invention which is intended to be unlimited by the foregoing descriptions of a preferred embodiment except as may appear from the following claims.

What is claimed is:

1. A method of making a face plate comprising:

forming a basic cavity in a base mold having an ejector half and a cavity half;

forming a first cavity portion in a main insert having an ejector half and a cavity half, the first cavity portion having a shape substantially corresponding to an overall size and shape of the face plate;

forming a second cavity portion in a sub-insert having an ejector half and a cavity half, the second cavity portion having a shape substantially corresponding to a particular feature of the face plate;

placing the sub-insert within the main insert, and the main insert within the base cavity, thus completely forming a face plate cavity;

filling the face plate cavity with material; and removing the face plate from the face plate cavity once the material has sufficiently cooled.

2. A method according to claim 1, wherein the basic cavity is substantially rectangular in shape.

3. A method according to claim 2, wherein the main insert is substantially of the same size and shape as the base cavity.

4. A method according to claim 3, wherein opposing surfaces of the sub-insert ejector half and sub-insert cavity half define a chevron-shaped surface which forms at least a portion of a front surface of the face plate.

5. A method according to claim 3, wherein opposing surfaces of the sub-insert ejector half and the sub-insert cavity half define a chevron-shaped surface which forms at least a portion of a front surface of the face plate, and wherein the method further comprises forming at least one port in a generally flat, inwardly and upwardly extending surface of the chevron-shaped surface.

6. A method according to claim 5, wherein the step of forming at least one port includes blocking flow of material in the second cavity portion with at least one of a port insert and a port extension formed on one of the sub-insert ejector half and the sub-insert cavity half.

* * * * *